US006566984B2

(12) United States Patent
Niiranen et al.

(10) Patent No.: US 6,566,984 B2
(45) Date of Patent: May 20, 2003

(54) RESONATOR FILTER WITH REDUCED VARIATION IN THE PASS BAND ATTENUATION

(75) Inventors: Erkki Niiranen, Ii (FI); Tapani Vistbacka, Kempele (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/956,647

(22) Filed: Sep. 19, 2001

(65) Prior Publication Data

US 2002/0036551 A1 Mar. 28, 2002

(30) Foreign Application Priority Data

Sep. 22, 2000 (FI) ..... 20002091

(51) Int. Cl.[7] ..... H01P 1/20
(52) U.S. Cl. ..... 333/202; 333/203
(58) Field of Search ..... 333/202, 203, 333/206

(56) References Cited

U.S. PATENT DOCUMENTS 5,379,011 A * 1/1995 Sokola et al. ..... 333/206
5,537,085 A * 7/1996 McVeety ..... 333/206
5,708,404 A * 1/1998 Kurisu et al. ..... 333/202
6,215,376 B1 * 4/2001 Hagstrom et al. ..... 333/203
6,326,867 B1 * 12/2001 Lee et al. ..... 333/202

FOREIGN PATENT DOCUMENTS

| | | | |
|---|---|---|---|
| EP | 0525416 | 7/1992 | ..... H01P/1/205 |
| JP | 2000022403 | 1/2000 | ..... H01P/1/20 |

* cited by examiner

*Primary Examiner*—Michael Tokar
*Assistant Examiner*—Lam T. Mai
(74) *Attorney, Agent, or Firm*—Darby & Darby

(57) ABSTRACT

The invention relates to a bandpass filter comprised of coaxial resonators. On the side of a resonator chain (200) which makes the filter there is provided an additional equalizing resonator (EQ1) which is coupled to a resonator (R3) in the chain. The resonance frequency of the equalizing resonator and the coupling with the rest of the filter are arranged so that attenuation increases at a point corresponding to an original attenuation minimum. Thereby it follows that attenuation variation in the whole pass band decreases. Response equalization can be further enhanced by providing a second equalizer (EQ2) affecting a band beside the first one. Using the structure according to the invention, a decrease of a certain magnitude in the pass band attenuation variation of a bandpass filter can be achieved with a smaller increase in the number of resonators than in known structures. Moreover, the production costs caused by the additional structure are relatively small.

11 Claims, 5 Drawing Sheets

RESONATOR FILTER WITH REDUCED VARIATION IN THE PASS BAND ATTENUATION

The invention relates to a filter structure comprised of coaxial resonators, which structure is especially applicable as an antenna filter for base stations of radio networks.

The requirements imposed upon a radio-frequency filter of a base station are relatively strict regarding e.g. the width of the transition band between the pass band and stop band as well as the stop band attenuation. Therefore, the order of the filter tends to be rather high. For the resonator filter this means that the structure will comprise several individual resonators and coupling arrangements therebetween. On the other hand, the attenuation of the filter shall be low in the pass band, which limits the number of resonators as well as their losses.

Figure 1:
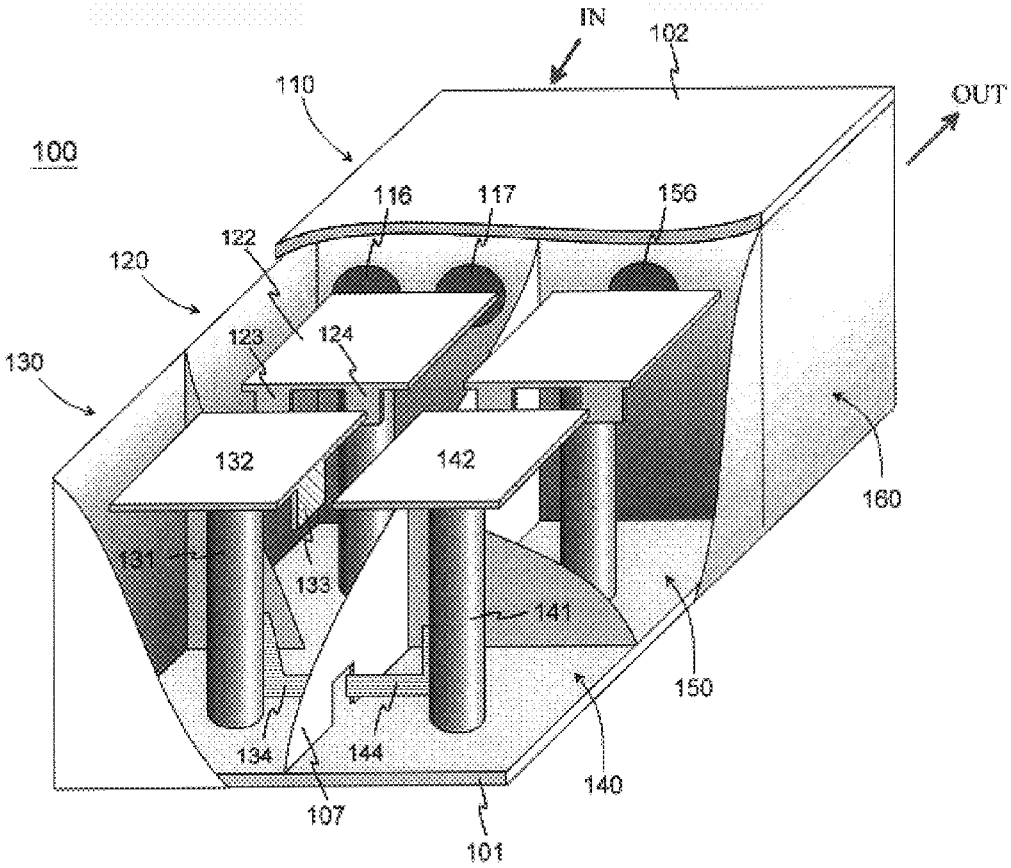
Fig. 1 PRIOR ART

There are several known filter structures based on resonators. Resonators are usually arranged in one or two rows so that they constitute a metal casing which appears as a single block when viewed from the exterior. The most common resonator type is the coaxial quarter-wave resonator. Inter-resonator coupling, which is accomplished by means of auxiliary parts, is either capacitive or inductive. Coupling mechanism details may vary to a great extent. FIG. 1 shows an example of such a prior-art filter partly cut open. It comprises a total of six coaxial resonators the cavities of which are formed so that the space of the metal casing of the filter is divided by one longitudinal and two transversal partition walls into two three-cavity rows. The first row comprises the first 110, second 120, and the third 130 resonator. The second row comprises the fourth 140, fifth 150, and the sixth 160 resonator so that the sixth resonator is side by side with the first resonator. Couplings in the filter are such that the signal is brought into the first resonator 110 and it travels a U-shaped path via the second, third, fourth and fifth resonators into the sixth resonator 160 where it goes out. Each resonator comprises an inner conductor, such as 131 and 141, depicted vertical in FIG. 1, and a horizontal planar extension to the inner conductor, such as extensions 132 and 142. The extension adds to the capacitance in the upper end, or the open end, of the structure, thereby the resonator can be made shorter in the vertical dimension. Each resonator further comprises an outer conductor comprised of parts of the resonator partition walls, side walls of the whole filter case, and end walls in some resonators. The structure is a quarter-wave resonator because each inner conductor is by its lower end connected to a conductive bottom plate 101 which is part of the signal ground. The line comprised of the inner conductor and outer conductor is thus short-circuited at its lower end. The structure includes a conductive cover 102 so that the filter case is closed. FIG. 1 shows some of the inter-resonator couplings. On the same height with the extensions of inner conductors there are two apertures 116, 117 in the partition wall between the first and the second resonator so that the said resonators are capacitively coupled through the said apertures. A similar aperture 156 can be seen in the partition wall between the fifth and the sixth resonator. In the partition wall between the second and the third resonator there are similar apertures which cannot be seen in FIG. 1 because the partition wall has been cut out. Instead the Figure shows two vertical projections 123, 124 in the extension 122 of the inner conductor of the second resonator, placed so as to face the apertures in the partition wall between the second and the third resonator, thereby adding to the strength of capacitive coupling. A similar vertical projection 133 is found in the extension of the inner conductor of the third resonator, facing the aperture (not shown) in the partition wall between the third and the fourth resonator. Moreover, there is inductive coupling between the third and the fourth resonator. This is realized by means of conductive projections 134, 144 at the lower ends of the inner conductors 131, 141 and an aperture in the lower part of the partition wall 107.

Filters like the one depicted in FIG. 1 are often realized as Chebyshev filters because this structure is the most convenient for producing the required narrow transition band on one side of the pass band. On the other hand, Chebyshev approximation means that there will appear pass band attenuation variation in the amplitude response of the filter. To reduce the pass band attenuation variation, one needs to increase the order of the filter and, thus, increase the number of resonators. More resonators in the signal path may in turn raise the basic pass band attenuation too high.

An object of the invention is to alleviate the said disadvantage associated with the prior art. The structure according to the invention is characterized by that which is specified in the independent claim 1. Some preferred embodiments of the invention are specified in the other claims.

The basic idea of the invention is as follows: on the side of a resonator chain constituting a bandpass filter there is provided an additional equalizing resonator, coupled to a resonator in the chain. The resonance frequency of the equalizing resonator and its coupling to the rest of the filter are arranged so that the transfer function of the filter gets a new zero at a point corresponding to an attenuation minimum. Thereby the attenuation at that point increases with the result that attenuation variation in the whole pass band decreases. The Q factor of the equalizing resonator is arranged to be so small that the arrangement increases filter attenuation over a relatively wide range within the pass band. Response equalization can be further enhanced by providing a second equalizing resonator having an affecting band beside the first one.

An advantage of the invention is that pass band attenuation variation in a bandpass filter can be reduced with a smaller increase in the basic attenuation than in known structures. Resonators are added in both cases. The difference is explained by the fact that the arrangement according to the invention requires a smaller number of extra resonators and the added resonators have a lower energy content than the resonators of a conventional structure. Another advantage of the invention is that the production costs caused by the additional structure according to the invention are relatively small.

Figure 2:
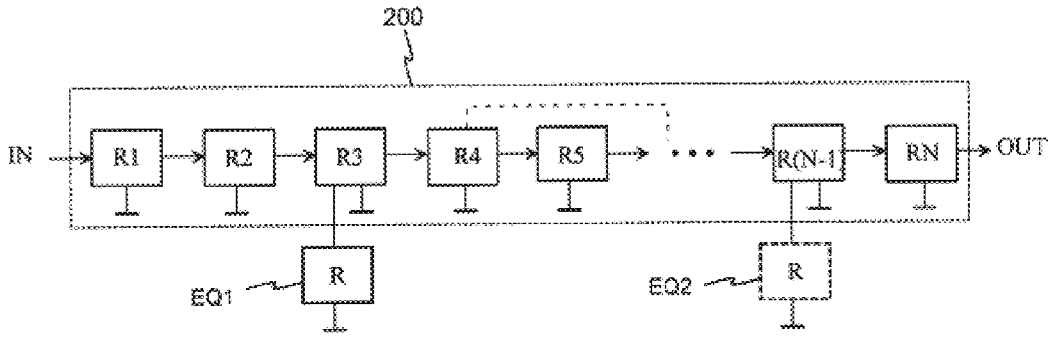
Figure 4:
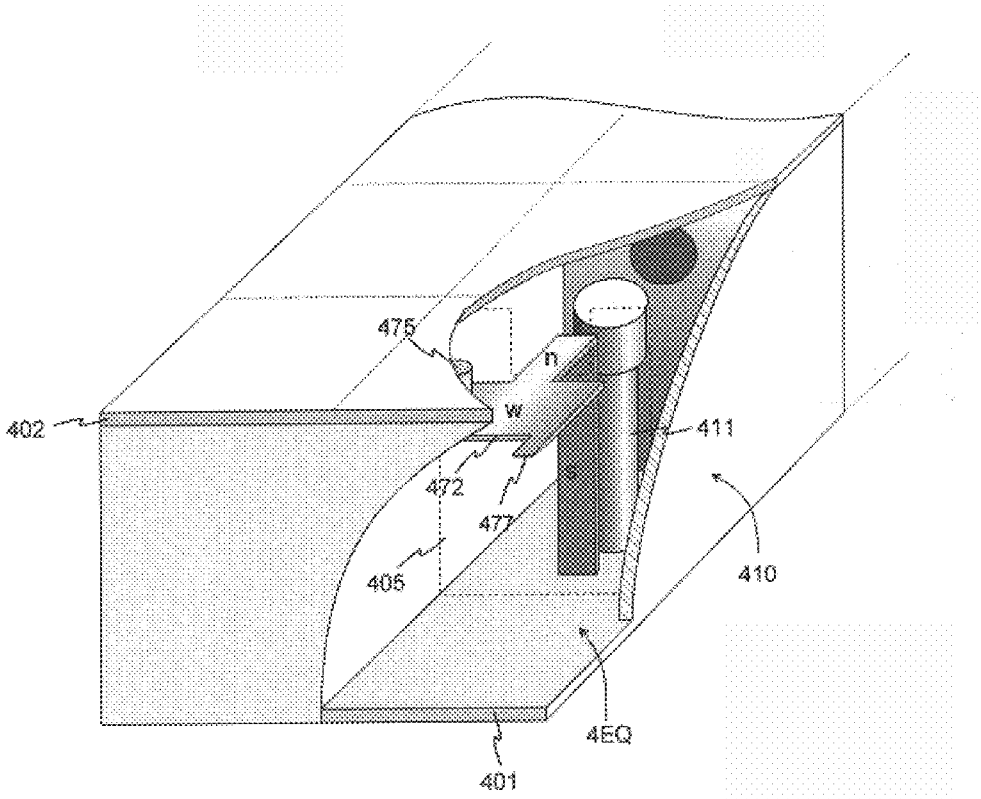
Figure 5:
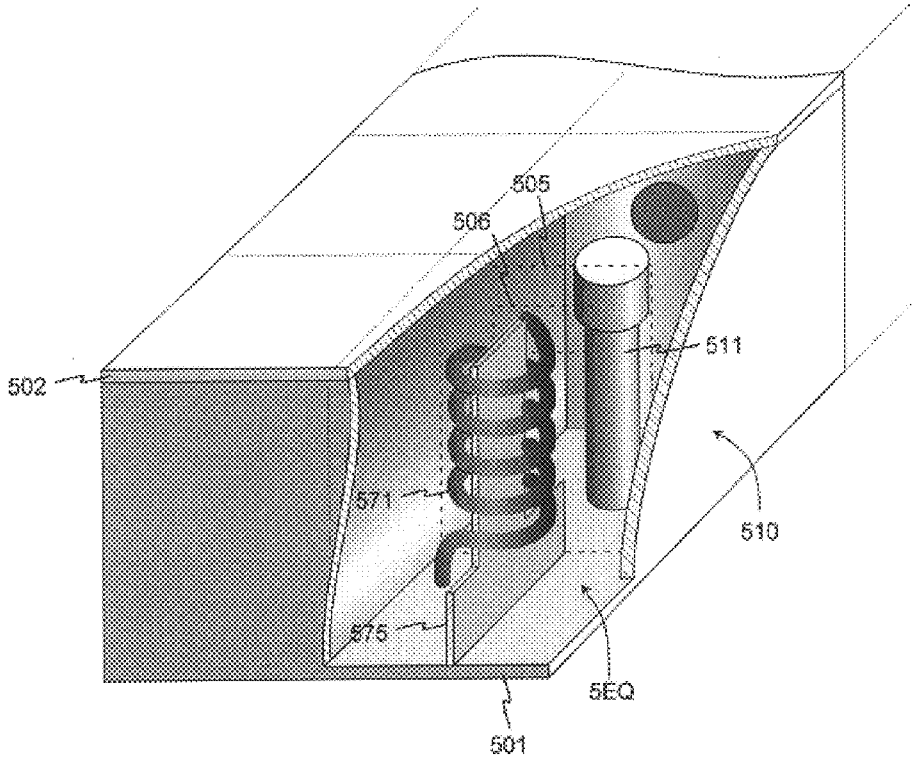
Figure 6:
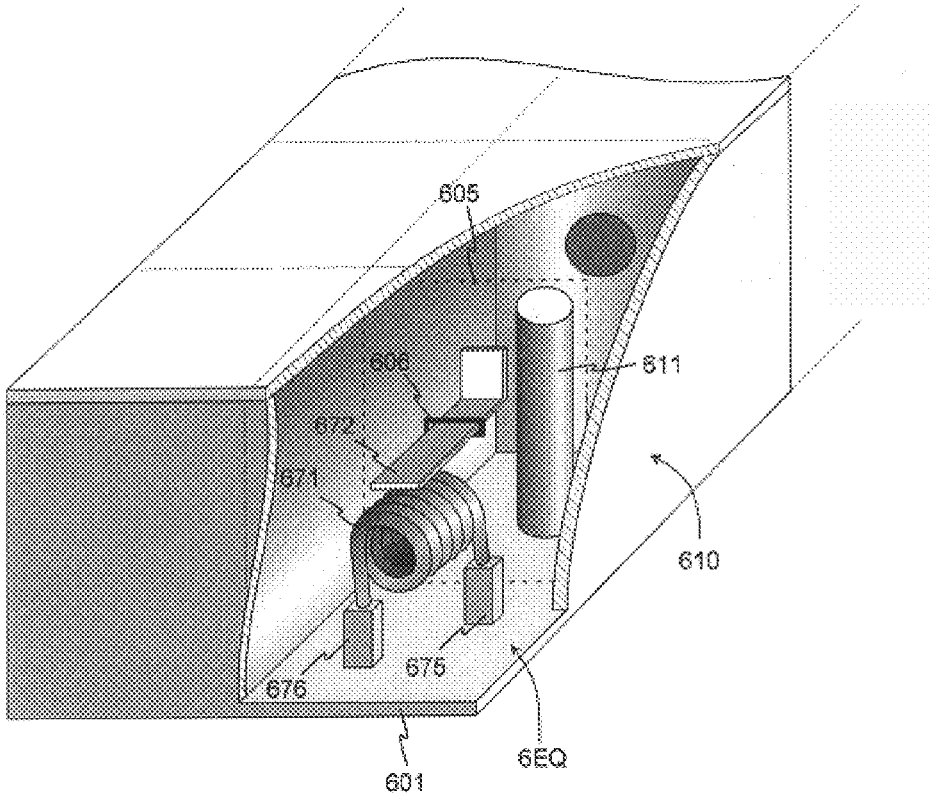
Figure 7:
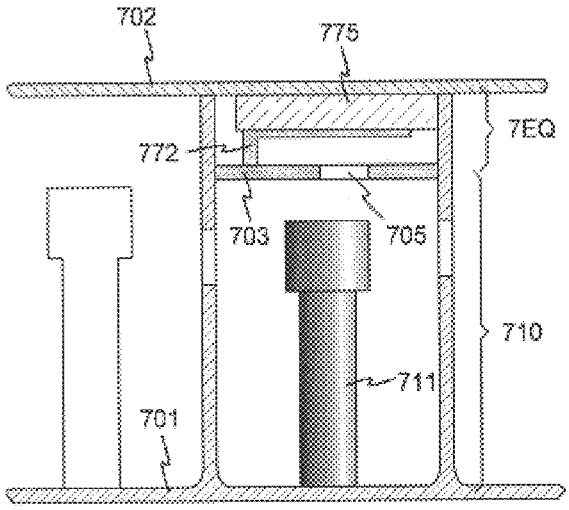
Figure 8:
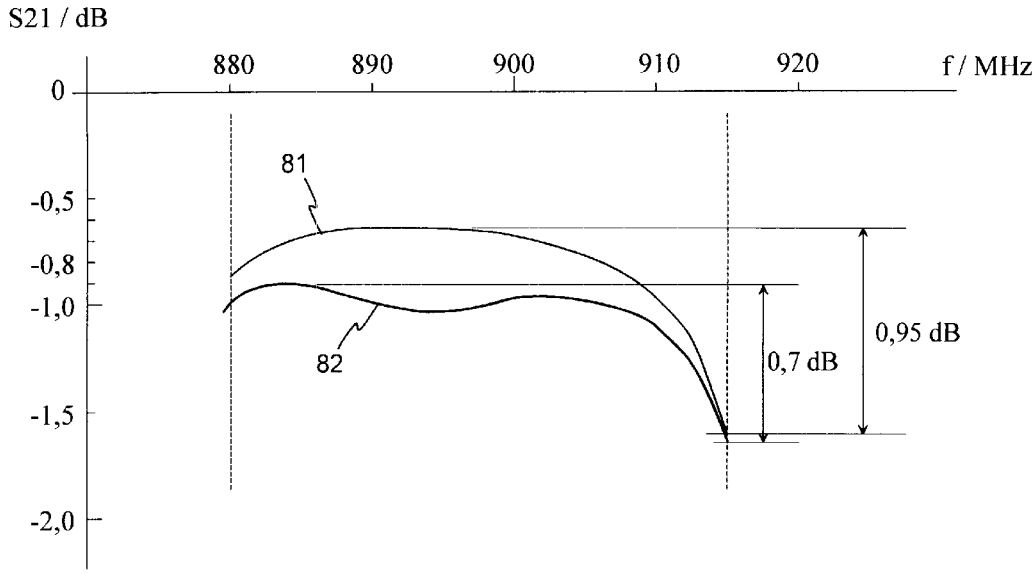
Figure 9:
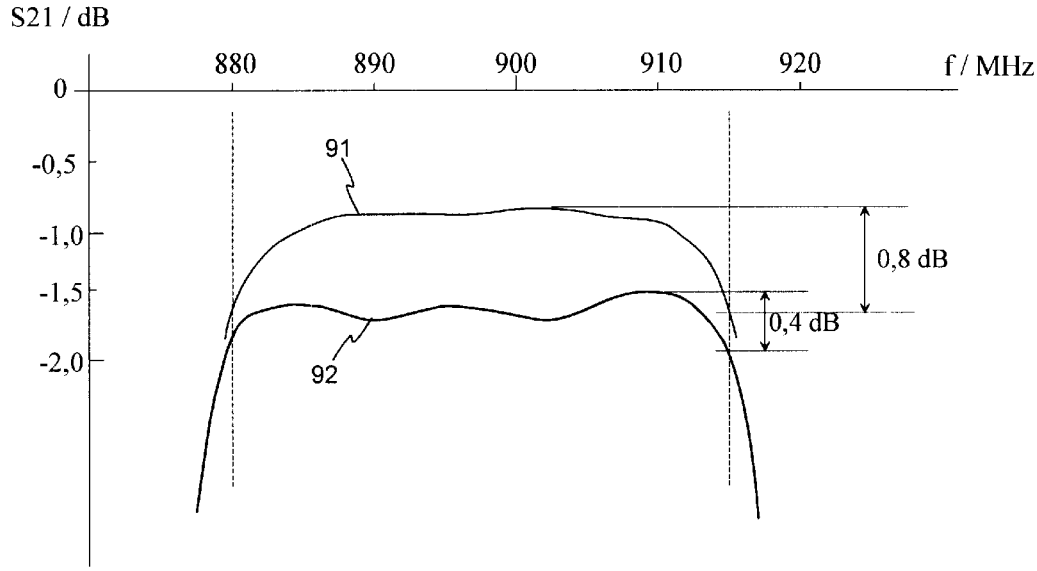

The invention is below described in closer detail. The description refers to the appended drawings, in which FIG. 1 shows a resonator filter according to the prior art, FIG. 2 shows the principle of the structure according to the invention, FIG. 3 shows an example of a resonator filter according to the invention, FIG. 4 shows a second example of a resonator filter according to the invention, FIG. 5 shows a third example of a resonator filter according to the invention, FIG. 6 shows a fourth example of a resonator filter according to the invention, FIG. 7 shows a fifth example of a resonator filter according to the invention, FIG. 8 shows an example of an improvement in amplitude response achieved through the invention, and FIG. 9 shows a second example of an improvement in amplitude response achieved through the invention.

FIG. 1 was already discussed in conjunction with the description of the prior art. FIG. 2 shows a block diagram of the structure according to the invention. There is seen an original prior-art resonator filter 200 comprising N resonators R1 to RN connected in series. In the example, an equalizing resonator or an equalizer EQ1 is coupled to resonator R3 in accordance with the invention. A potential second equalizer EQ2, depicted in dashed line, is in the example coupled to the last but one resonator R(N−1). Equalizers EQ1 and EQ2 form laterals in the filter structure. In the claims, therefore, we will call resonators corresponding to R3 and R(N−1) node resonators.

Figure 3:
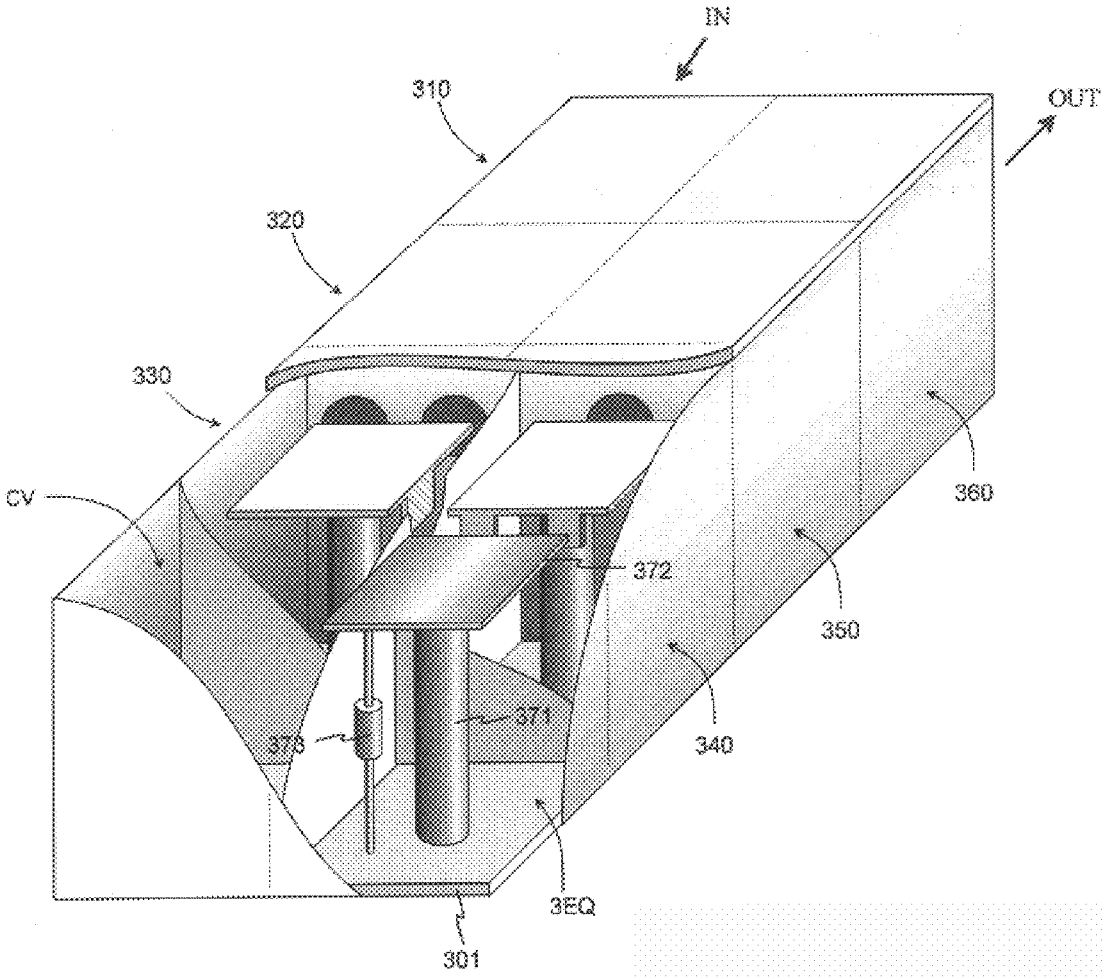

FIG. 3 shows an example of the structure according to the invention. In this example, six resonators 310 to 360 constitute a basic filter like the one in FIG. 1. The filter case is in this example longer than that shown in FIG. 1 so that there are two more cavities at the front end of the filter, where "front end" only refers to the position shown in the drawing. One of these cavities houses an equalizer 3EQ according to the invention. The latter has capacitive coupling with the nearest filter resonator, i.e. the fourth resonator 340. In addition to the walls the equalizer comprises a vertical inner conductor 371 and a horizontal and planar extension 372 thereof. "Vertical" and "horizontal" as well as "lower end" and "upper end" refer in this description and in the claims to the positions of constituent parts shown in FIGS. 3 to 7; these terms have nothing to do with the use position of the filter.

The equalizer is designed so that its own resonance frequency is above the pass band of the filter. This resonance is parallel resonance. Together with the coupling capacitance the equalizer constitutes a series resonance circuit at a pass band frequency. The series resonance produces a zero in the transfer function of the filter at a complex frequency variable value. At a corresponding real frequency variable value an increase in attenuation takes place. In FIG. 3 the equalizer further comprises a resistive component 373 which is connecteid in between a point in the extension of the inner conductor and the bottom plate 301 which provides signal ground. Component 373 decreases the Q factor of the equalizer, resulting in the increase in the attenuation caused by the equalizer to occur in a wider frequency band, evening out the pass band attenuation variation in the amplitude response.

In FIG. 3 there is an empty cavity CV beside the equalizer 3EQ. Also this cavity CV could be included in the amplitude response equalization if it contained a resonator coupled to the third resonator 330.

FIG. 4 shows a second example of the structure according to the invention. In this example, a cavity in a filter case, which comprises a plurality of cavities, is reserved for an equalizer 4EQ. This is coupled to the neighboring resonator 410. The most essential component in this structure is a conductive strip 472. The conductive strip 472 comprises, in the upper part of resonator 4EQ, a relatively wide horizontal and planar part w, relatively narrow horizontal and planar part n as an extension to the former, extending through an aperture in the partition wall 405 into the neighboring resonator 410, and a vertical part s as an extension to the narrow part n, extending to the bottom 401 of the case. For clarity, the partition wall 405 is shown only in dashed line. The vertical part s is in the cavity of resonator 410, close to the inner conductor 411 of the resonator, providing electromagnetic coupling between resonators 410 and 4EQ. The conductive strip is attached by its wide portion w to the cover 402 of the filter case by means of dielectric blocks, such as 475.

Together with the conductive parts of the filter case and the medium the conductive strip 472 constitutes a transmission line. Looking from the neighboring resonator, i.e. the feeding end, the other end of the transmission line is open. When the electrical length of such a transmission line equals a quarter-wave, it corresponds to a series resonance circuit. With dimensions of the conductive strip 472, distance between the strip and the cover and side walls of the case, and insulating materials, the electrical length of the transmission line can be arranged suitable. For fine-tuning the conductive strip may comprise a small bendable projection 477, for example. Furthermore, the structure may contain dielectric material in order to reduce the Q factor of the equalizer and, thus, expand the frequency band where the equalization is effective. Moreover, the Q factor may be influenced through the location of the conductive strip and by altering the discontinuity in the transmission line, i.e. the interrelationship between the wide portion w and narrow portion n in the conductive strip.

FIG. 5 shows a third example of the structure according to the invention. In this example, too, there is a multi-cavity filter case one cavity of which is reserved for an equalizer 5EQ. This structure differs from that of FIG. 3 in that the inner conductor of the equalizer is now of the helix type instead of a straight inner conductor extended at its upper end. The helix conductor 571 is galvanically connected by its lower end to the bottom of the case. The helix conductor is supported by a dielectric plate 575 which is attached to the bottom of the filter case and extends to the upper end of the helix, within the helix. In this case, too, the dielectric material of the structure is not an electrical disadvantage, but its losses can be utilized in setting the Q factor of the resonator suitably "poor". Moreover, the Q factor can be influenced by the material and design of the helix conductor itself. If necessary, an additional resistor, like in FIG. 3, can be used, for example. The energy required for oscillation comes electromagnetically to the equalizer 5EQ from the neighboring resonator 510 via an aperture 506 in the partition wall 505. Of course, a more purely inductive coupling at the lower end of the resonators could also be used.

FIG. 6 shows a fourth example of the structure according to the invention. In this example, the equalizer 6EQ consists of the walls of the resonator cavity, a coil 671 in the cavity, and a coupling strip 672 extending from above the coil into the neighboring resonator 610, near to the inner conductor 611 thereof. The coupling strip continues through an aperture in the partition wall 605 between the said resonators and is attached to the partition wall by means of a dielectric element 606, which isolates the strip from the partition wall. The coupling strip is not essential; it can be left out if sufficient coupling can be achieved by the aperture in the partition wall alone. The coil 671 is attached by its ends to the bottom 601 of the case by means of dielectric pieces 675, 676. Thus the coil has only electromagnetic, mainly capacitive, coupling with the signal ground, which is essential to this embodiment. In order to increase the capacitance, the conductor of the coil inside the blocks 675 and 676 can be extended close to the bottom of the case. In this example, too, the circuit influencing the neighboring resonator 610, which circuit has in addition to the coil and the capacitances thereof, a series capacitance determined by the coupling strip 672, is arranged so as to resonate at a desired point of the pass band of the whole filter. A separate capacitor may also be installed in the dielectric blocks 675, 676 in order to increase the capacitance of the circuit, thus the physical size of the coil can be made smaller. This also provides a means for influencing the Q factor of the equalizer at the same time.

FIG. 7 shows a fifth example of the structure according to the invention. There is seen in longitudinal section a filter resonator 710 to which an equalizer is coupled. The equalizer 7EQ itself is now placed in the original cavity of resonator 710 by separating a discrete small cavity in the upper part of the cavity by means of a horizontal partition wall, or partition cover 703. This small cavity includes the inner conductor 722 of the equalizer, one end of which is connected via the partition cover 703 to the signal ground. Between the inner conductor 722 and the cover 702 of the whole filter case there is a dielectric element 775 made of Teflon, for example. This considerably reduces the space required by the equalizer. At the same time the resonator's Q factor is decreased. In the example of FIG. 7, the coupling between the equalizer 7EQ and the resonator 710 in the signal path of the filter is realized by means of an aperture 705 in the partition cover 703.

In the example of FIG. 7, the addition of the equalizer in the filter structure does not increase the space required by the filter. In a similar manner, the equalizer could be added on the partition wall, outer wall or bottom of a resonator.

FIG. 8 shows an example of an improvement in amplitude response achieved by the invention. On the vertical axis there is parameter S21 which represents attenuation of signal in a filter. The variable on the horizontal axis is frequency. Curve 81 shows the amplitude response of a prior-art filter in a pass band which is 880 to 915 MHz. The pass band attenuation of the filter varies between the values 0.6 dB and 1.55 dB. Curve 82 shows the amplitude response of a filter provided with an equalizer according to FIG. 4. The pass band attenuation now varies between 0.9 dB and 1.6 dB. Thus, the addition according to the invention reduces the pass band attenuation variation from 0.95 dB down to 0.7 dB. At the same time, mean pass band attenuation increased by a little more than 0.2 dB, but is still within allowable limits. A corresponding improvement in the filter response by raising the order of the filter would require more additional resonators and, possibly, thicker constituent parts in order to reduce losses.

FIG. 9 shows a second example of an improvement in amplitude response achieved by the invention. Curve 91 shows the amplitude response of a prior-art filter. The pass band attenuation of the filter varies between values 0.8 dB and 1.6 dB. Curve 92 shows the amplitude response of a filter provided with two equalizers like the one depicted in FIG. 3. The pass band attenuation now varies between 1.5 dB and 1.9 dB. Thus, the addition according to the invention reduces the pass band attenuation variation from 0.8 dB down to 0.4 dB.

Above it was described some solutions according to the invention. The invention is not limited solely to those. The shapes of equalizer parts may vary to a great extent. The materials of both the conductive parts and dielectric parts may vary. Nor does the invention limit the manufacturing method of the structure. The inventional idea may be applied in different ways within the scope defined by the independent claim.

What is claimed is:

1. A resonator filter comprising in an electrically conductive casing at least three resonators electromagnetically connected in series, whereby at least one of the said three resonators is a node resonator and the filter further comprises an equalizing resonator having conductive walls and, in the cavity confined by the said walls, an inner conductor, and which equalizing resonator is electromagnetically coupled to the said node resonator in order to reduce variation in the pass band attenuation of the filter.

2. A filter according to claim 1, whereby the inner conductor of the equalizing resonator is galvanically connected by its lower end to the bottom of the filter casing and is open at its upper end.

3. A filter according to claim 2, whereby said inner conductor is straight and extended at its upper end to increase capacitance with the walls of the equalizing resonator and to provide for capacitive coupling with the node resonator through an aperture in a partition wall between resonators.

4. A filter according to claim 2, whereby said inner conductor is a helix conductor capacitively coupled at its upper end to the node resonator through an aperture in a partition wall between resonators.

5. A filter according to claim 1, whereby said inner conductor is a substantially horizontal conductive plane isolated from the walls of the equalizing resonator, with a relatively wide portion and relatively narrow portion and which narrow portion extends through an aperture in a partition wall into the cavity of a node resonator and, in the cavity, further to the bottom of the filter casing.

6. A filter according to claim 1, whereby the cavity of the equalizing resonator is substantially smaller than the cavity of the node resonator and located above or under the node resonator.

7. A filter according to claim 1, whereby said inner conductor is a coil conductor isolated from the walls of the equalizing resonator, which coil has capacitive coupling to the node resonator through an aperture in a partition wall.

8. A filter according to claim 7, whereby the axis of the coil is substantially horizontal, and the filter comprises a conductive strip substantially parallel to said axis, extending into the cavity of the node resonator through an aperture in the partition wall to provide for a capacitive coupling with the node resonator.

9. A filter according to claim 1, whereby the equalizing resonator comprises a constituent part which increases losses to increase the bandwidth of the equalizing resonator.

10. A filter according to claim 9, whereby said constituent part which increases losses is a resistor connected between the upper part of said inner conductor and the bottom of the filter casing.

11. A filter according to claim 9, whereby said constituent part which increases losses is a dielectric element between said inner conductor and a conductive wall of the equalizing resonator.

* * * * *